US006445346B2

(12) United States Patent
Fathy et al.

(10) Patent No.: US 6,445,346 B2
(45) Date of Patent: Sep. 3, 2002

(54) PLANAR POLARIZER FEED NETWORK FOR A DUAL CIRCULAR POLARIZED ANTENNA ARRAY

(75) Inventors: Aly E. Fathy, Langhorne, PA (US); Louis S. Napoli, Hamilton Square, NJ (US); Francis J. McGinty, Newtown, PA (US); David McGee, Hopewell, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/845,095

(22) Filed: Apr. 27, 2001

Related U.S. Application Data

(60) Provisional application No. 60/200,069, filed on Apr. 27, 2000.

(51) Int. Cl.[7] ..... H01Q 1/38; H01Q 21/00

(52) U.S. Cl. ..... 343/700 MS; 343/824; 343/846; 343/853

(58) Field of Search ..... 343/700 MS, 824, 343/846, 853

(56) References Cited

U.S. PATENT DOCUMENTS 5,241,321 A * 8/1993 Tsao ..... 343/700 MS
5,661,494 A * 8/1997 Bondyopadhyay ... 343/700 MS
5,717,407 A * 2/1998 Hong ..... 343/700 MS

* cited by examiner

*Primary Examiner*—Don Wong
*Assistant Examiner*—Hoang Nguyen
(74) *Attorney, Agent, or Firm*—William J. Burke

(57) ABSTRACT

A planar polarizer feed network comprising a six port branch coupler having two input ports and four output ports. The output ports are designed to have the same amplitude while their phases are sequentially offset by 90 degrees when fed from a first input port or by minus 90 degrees when fed from a second input port. In one embodiment, each output port is coupled to an aperture coupled antenna array comprising four slots and four patch antenna elements. In this arrangement, an RF signal may be coupled to each of the two input ports to couple properly phased signals to each of the antenna elements to simultaneously form both right-hand and left-hand circularly polarized signal emitted from the planar array of antenna elements.

14 Claims, 3 Drawing Sheets

200

PLANAR POLARIZER FEED NETWORK FOR A DUAL CIRCULAR POLARIZED ANTENNA ARRAY

CROSS-REFERENCE TO RELATED APPLICATIONS

This application claims benefit of U. S. provisional patent application serial No. 60/200,069, filed Apr. 27, 2000, which is herein incorporated by reference.

BACKGROUND OF THE INVENTION

1. Field of the Invention

The present invention generally relates to circularly polarized antenna arrays and, more particularly, to feed networks for circularly polarized antenna arrays.

2. Description of the Related Art

Circularly polarized planar antennas have been widely used for various applications such as a phased array antennas, mobile antennas, and for satellite antennas. In many cases, the antennas are required to support simultaneous dual polarization, where a sequential signal rotation and phase shift technique has proven to provide wide band circular polarization and low VSWR characteristics. Such dual polarization is used in direct broadcast satellite television systems to enable a single antenna to be used to simultaneously receive multiple channels.

More particularly, circular polarization in planar antenna arrays is accomplished by the system having a plurality of "patch" antennas where a linearly polarized signal is coupled to each of the antenna elements. The signal is applied to the elements in a sequentially switched pattern to achieve circular polarization in either right-hand or left-hand form. However, such switched systems require sophisticated electronics and a substantial amount of microstrip or stripline circuitry to couple the RF signals to the antenna elements. Such circuit complexity results in substantial crosstalk between antenna elements and distortion of the antenna pattern.

Therefore, there is a need in the art for a simple feed network for a dual circular polarized antenna array.

SUMMARY OF THE INVENTION

The present invention is a planar polarizer feed network comprising a six port network having two input ports and four output ports. The output ports are designed to have the same amplitude while their phases are sequentially offset by 90 degrees when fed from a first input port or by minus 90 degrees when fed from a second input port. In one embodiment of the invention, each output port is coupled to an aperture coupled antenna element comprising a slot and a patch antenna element. In this arrangement, an RF signal may be coupled to each of the two input ports to couple properly phased signals to each of the four antenna elements to simultaneously form both right-hand and left-hand polarized signal emitted from a planar array of antenna elements.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention is a planar polarizer feed network for a dual circular polarized antenna array system. The planar polarized feed network distributes an RF signal to an array of four antenna elements such that both a right-hand and a left-hand polarized signal can be transmitted from the antenna system or received by the antenna system.

Figure 1:
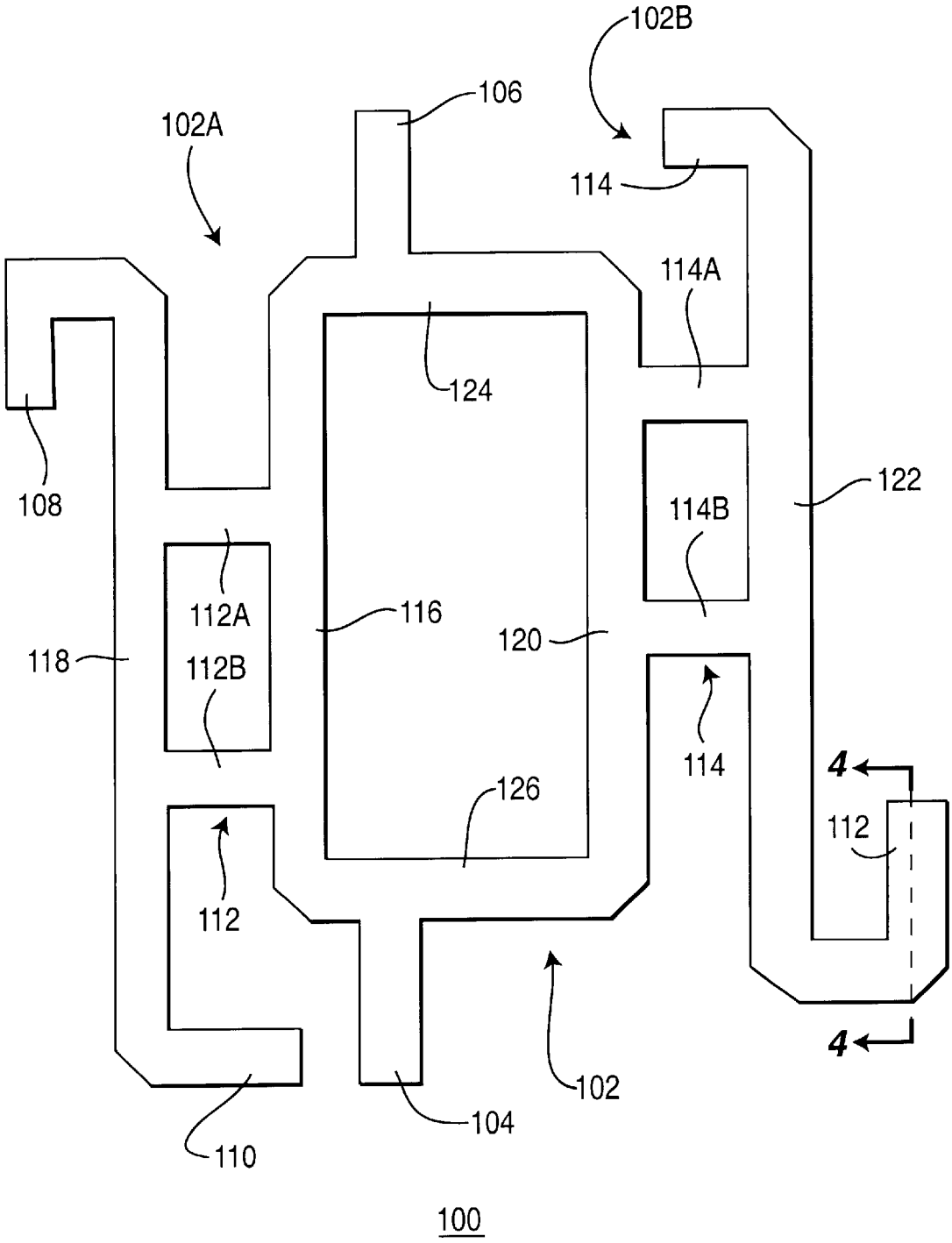
FIG. 1 depicts a top plan view of a six port planar feed network of the present invention.

FIG. 1 depicts the top plan view of a six port, planar polarizer feed network 100 of the present invention. The feed network 100 is comprised of six ports: two input ports 104 and 106 and four output ports 108, 110, 112 and 114. The feed network 100 is formed as a microstrip circuit (stripline may also be used). When driving the feed network 100 from input port 104 with an RF signal, output port 110 will generate a signal that is in-phase with the input signal the output port 108 will generate a signal that is 90 degrees out of phase with the input signal, output port 114 will generate a signal that is 180 degrees out of phase with the input signal, and output port 112 will generate a signal that is 270 degrees out of phase with the input signal. Similarly, when driving the network 100 through input port 106, the feed network 100 produces a signal at port 108 that is in-phase with the input signal, output port 110 generates a signal that is 90 degrees out of phase with the input signal, output port 112 generates a signal that is 180 degrees out of phase with the input signal and output port 114 generates a signal that is 270 degrees out of phase with the input signal. As discussed below, both input ports may be driven simultaneously.

The feed network 100 comprises a pair of branch line couplers 102A and 102B that are connected together. The first branch line coupler 102A is formed of a trunk line 116 that is connected to a distribution line 118 by a pair of branch lines 112A and 112B. Similarly, the second branch line coupler 102B is formed of a trunk line 120 coupled to a second distribution line 122 by a pair of branch lines 114A and 114B. The ends of each trunk line are connected to one another by cross lines 124 and 126. The input port 106 is connected to cross line 124 and input port 104 is connected to cross line 126. The positioning of the branch lines 114 and 112 off of the trunk lines 116 and 120 are defined by the frequency and bandwidth necessary for the particular network being designed. The design of branch line couplers having phase shifted output signals is well known in the art.

Figure 2:
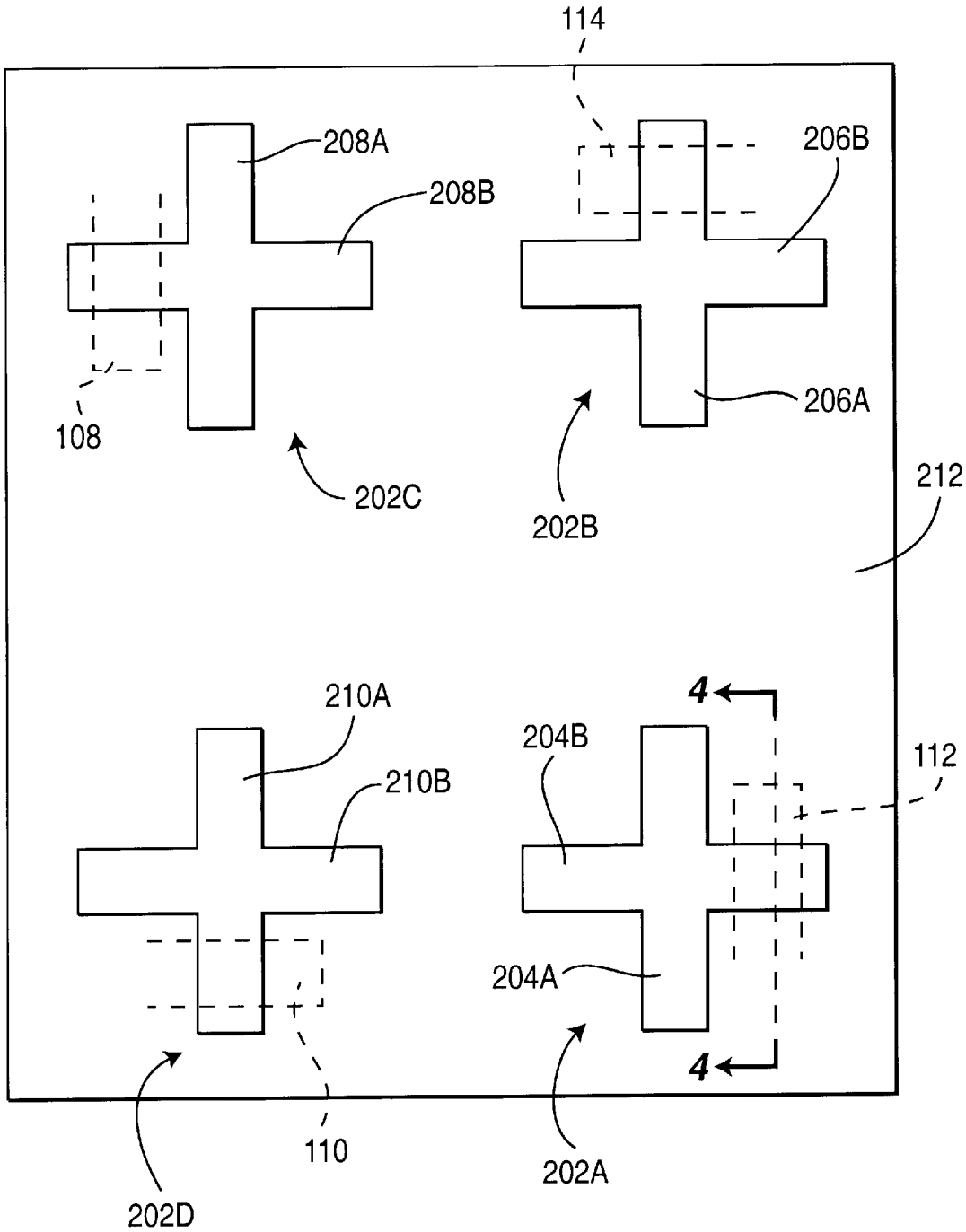
FIG. 2 depicts a top plan view of a crossed aperture array for an antenna array incorporating the feed network of FIG. 1.
Figure 3:
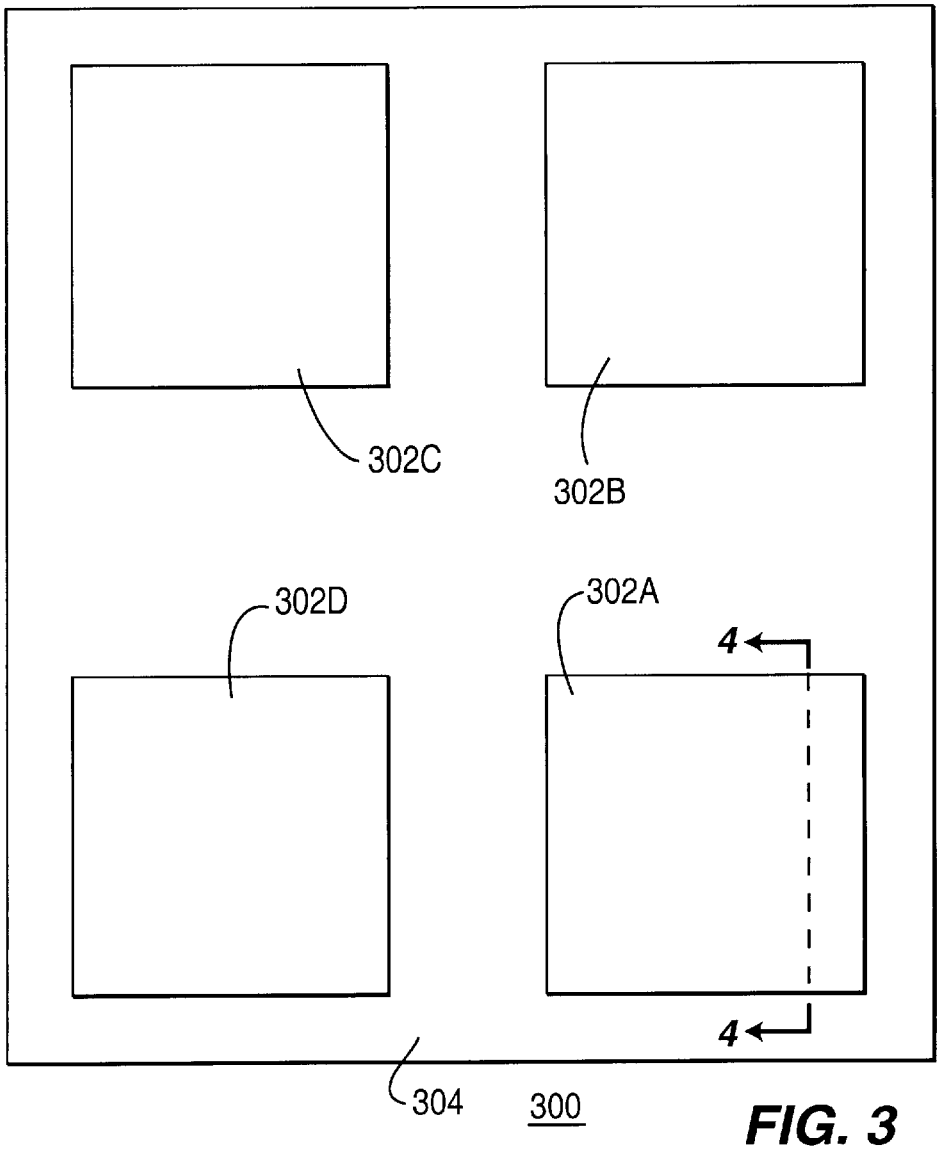
FIG. 3 depicts top plan view of a four antenna element array for an antenna array incorporating the feed network of FIG. 1 and the aperture array of FIG. 2.
Figure 4:
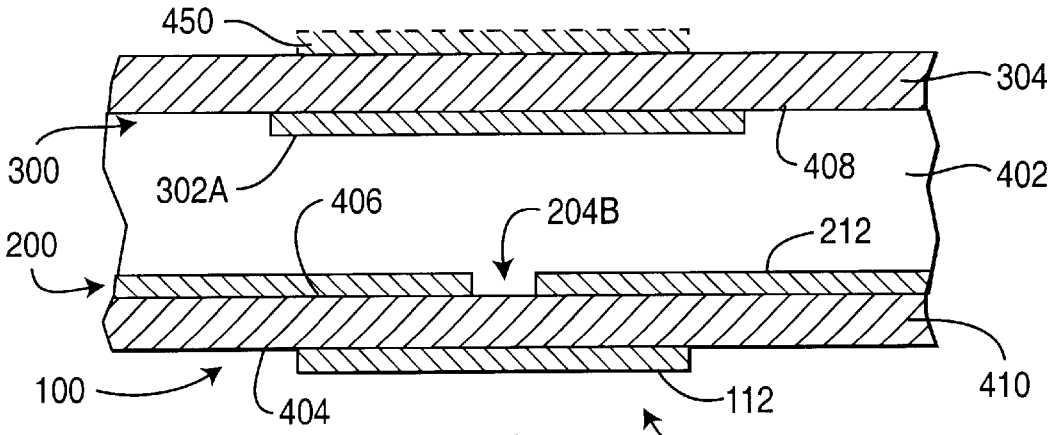
FIG. 4 depicts a cross sectional view taken along lines 4—4 of the antenna system depicted in FIGS. 1, 2 and 3.

The output ports 108, 110, 112 and 114 of network 100 may be coupled to antenna elements in one of many different ways that are well known in the art. In one specific embodiment of the invention, the output ports are coupled through apertures to square planar antenna elements. FIGS. 2, 3 and 4 depict a specific embodiment of a planar antenna array system using the feed network of FIG. 1.

Specifically, FIG. 2 depicts a top plan field of a cross aperture array layer of the antenna array system, FIG. 3 depicts the top plan view of an antenna element array for the antenna array system, and FIG. 4 depicts a cross sectional view of the antenna array system. To best understand the invention the reader should simultaneously refer to FIGS. 1, 2, 3 and 4 while reading the following description of the antenna array system.

The antenna array system 400 is comprised of three dielectric layers 410, 402 and 304 (respectively, first, second and third dielectric layers) and three metallization layers that form the feed network 100, the array of apertures 200 and the array of patch antenna elements 300. The feed network 100, including output port 112, is formed on one surface 404 of a dielectric layer 410. The feed network 100 is formed using conventional microstrip techniques on surface 404 of dielectric layer 410. For example, the dielectric may be fabricated of RT-Duroid having a dielectric constant of approximately 2.2 or higher.

An array of cross apertures (e.g., four apertures 202A, 202B, 202C and 202D) are formed in a metal layer on surface 406 of dielectric layer 410. Each output port of the feed network 100 is coupled to a different arm of the cross apertures. The coupling is accomplished by having the output port microstrip 112 underlie the aperture arm 204B such that energy at the output port 112 is coupled through the aperture 202A.

A dielectric 402 is formed atop the aperture layer 212. This dielectric layer 402 may be a volume that is filled with air. Other materials having a dielectric constant of approximately 1, such as foam, can be used. Antenna elements 302A, 302B, 302C and 302D are square patches of metallization that are formed on surface 408 of dielectric layer 304. These antenna elements 302 are formed above each of the cross coupled apertures 202A, 202B, 202C and 202D. Energy from the output ports 108, 110, 112 and 114 of the feed network 100 is coupled through the apertures 202A, 202B, 202C and 202D to each of the antenna elements 302A, 302B, 302C and 302D. The dielectric layer 304 and the antenna elements 302 are either supported above dielectric layer 410 to form an air gap 402 or formed atop of a dielectric layer 402. The dielectric layer 304 forms an optional radome for the antenna system 400 protecting the underlying antenna components from the environmental elements. In one embodiment of the invention, the dielectric layer 304 has a dielectric constant of approximately 2.2 or higher and is fabricated of a material such a DT-Duroid or fiberglass (such as FR-4).

The six port planar feed network 100 is fabricated and independently tested to ensure that the output ports 108, 110, 112, 114 have equal amplitude output signals, and the required sequential phase distribution occurs. Phase errors can significantly degrade the axial ratio performance of the network 100, for example, a 10-degree error can cause an axial ratio of greater than 1.5 dB. The axial ratio provided by the following formula:

$$AR(dB)=\sqrt{A_e^{2+0.02250\phi_e^2}}$$

where $A_e$ is the amplitude error in dB and $\phi_e$ is the phase error in degrees.

In one specific embodiment of the invention, the spacing of the square antenna elements is generally 0.55 $\lambda_0$ where $\lambda_0$ is the drive or received frequency for the antenna system. One particular array comprises a first dielectric layer 410 having a dielectric constant of 2.22 and thickness of 20 mils, having air as the second dielectric 402 having a thickness of 60 mils and a third dielectric 304 having a dielectric constant of 2.22 and a 20 mil thickness. The invention provides more than 18 dB return loss over a 500 MHz bandwidth and better than 20 dB isolation. The measure of radiation pattern provides less than 1.5 dB axial ratio over a 500 MHz bandwidth centered at 12.5 GHz. The measured gain of the 2×2-patch antenna system was 10.5 to 11 dB over a 500 MHz bandwidth. By driving both input ports of the feed network simultaneously forming both right-hand and left-hand circularly polarized signals.

Although the depicted embodiment of the invention shows the patch antenna element being at the interface of the dielectric layer 304 and the dielectric layer 402, an alternative embodiment could have the patch antenna element positioned atop the dielectric layer 304, or above the dielectric layer 402 and not use the radome (i.e., dielectric layer 304).

Also, in another embodiment, additional patch antenna elements can be stacked atop the patch antenna elements 302. As such, at each location for a patch antenna element, one element is located on one side of dielectric layer 304 and another element is located on the other side of the dielectric layer 304. Such an element 450 is shown in phantom in FIG. 4. The dielectric layer 304 maintains the elements 302 and 450 in a parallel, spaced apart relationship. To adjust bandwidth and beam width parameters, the size of the upper patch element 450 may be different from the lower patch element 302, and the spacing between the elements can be adjusted. Such sizing and spacing parameters vary from application to application for the antenna. Furthermore, to adjust the coupling parameters between the stacked elements 302 and 450, the lower patch element 302 may contain a slot or other form of aperture (not shown).

The foregoing is directed to the preferred embodiment of the present invention, other and further embodiments of the invention may be devised without departing from the basic scope thereof, and the scope thereof is determined by the claims that follow.

What is claimed is:

1. A planar feed network comprising:

a first branch line coupler having a first output port, a second output port and a first trunk line:

a second branch line coupler having a second trunk line, a third output port and a fourth output port, where the first and second trunk lines are connected to each other by a first cross line and a second cross line; and a first input port is connected to said first cross line and a second input port is connected to said second cross line.

2. The planar feed network of claim 1 wherein a signal coupled to said first input port results in an output signal at said first output port that is in-phase with said input signal, an output signal at said second output port that is 90 degrees out of phase with said input signal, an output signal at said third output port that is 180 degrees out of phase with said input signal, an output signal at said fourth output port that is 270 degrees out of phase with said input signal.

3. The planar feed network of claim 1 wherein a signal coupled to said second input port results in an output signal at said first output port that is in-phase with said input signal, an output signal at said second output port that is −90 degrees out of phase with said input signal, an output signal at said third output port that is −180 degrees out of phase with said input signal, an output signal at said fourth output port that is −270 degrees out of phase with said input signal.

4. The planar feed network of claim 1 wherein a first input signal coupled to said first input port results in an output signal at said first output port that is in-phase with said first input signal, an output signal at said second output port that is 90 degrees out of phase with said first input signal, an output signal at said third output port that is 180 degrees out of phase with said first input signal, an output signal at said fourth output port that is 270 degrees out of phase with said first input signal, and wherein, simultaneously with said first input signal, a second input signal coupled to said second input port results in an output signal at said first output port that is in-phase with said second input signal, an output signal at said second output port that is −90 degrees out of phase with said second input signal, an output signal at said third output port that is −180 degrees out of phase with said second input signal, an output signal at said fourth output port that is −270 degrees out of phase with said second input signal.

5. The planar feed network of claim 1 wherein said trunk lines are coupled to said output ports via two branch lines and a distribution line.

6. The planar feed network of claim 5 wherein said trunk lines, branch lines, cross lines and distribution lines are fabricated of microstrip.

7. An antenna system comprising:

first dielectric layer having a first surface and a second surface;

a planar feed network located on the first surface of the first dielectric, having a first and second input ports and a first output port, a second output port, a third output port, and a fourth output port, where applying a first signal to said first input port produces output signals at each output port that are advanced ninety degrees for. each output port, and simultaneously applying a second input signal to the second input port produces output signals at each output port that are retarded ninety degrees for each output port;

a conductive layer, located on the second surface of the first dielectric, defining a plurality of slots, where each slot is vertically aligned with an output port of said planar feed network;

a second dielectric layer, located atop the conductive layer, having a first surface and a second surface, where the first surface of the second dielectric contacts the conductive layer;

a plurality of patch antenna elements, located on the second surface of the second dielectric, where each of the patch elements is vertically aligned with a slot.

8. The antenna system of claim 7 further comprising a third dielectric layer located atop the plurality of patch antenna elements.

9. The antenna system of claim 8 wherein the third dielectric layer forms a radome.

10. The antenna system of claim 8 further comprising a second plurality of patch antenna elements located atop the third dielectric layer, where each of said patch antenna elements in second plurality of patch antenna elements is aligned with a patch antenna element atop said second dielectric layer.

11. The antenna system of claim 10 wherein said patch antenna elements atop said second dielectric define an aperture.

12. The antenna system of claim 7 wherein the second dielectric is air.

13. The antenna system of claim 7 wherein the slots are crossed slots, where each arm or a crossed slot is vertically aligned with an output port of the planar feed network.

14. The antenna system of claim 7 wherein the patch antenna elements are square.

* * * * *

UNITED STATES PATENT AND TRADEMARK OFFICE

CERTIFICATE OF CORRECTION

PATENT NO. : 6,445,346 B2 
DATED : September 3, 2002
INVENTOR(S) : Aly E. Fathy, Louis S. Napoli, Francis J. McGinty and David McGee It is certified that error appears in the above-identified patent and that said Letters Patent is hereby corrected as shown below:

Column 5,
Line 30, please change "for." to -- for --.

Column 6,
Line 22, after "patch antenna element" please add -- located --.

Signed and Sealed this

Tenth Day of December, 2002

JAMES E. ROGAN
*Director of the United States Patent and Trademark Office*